United States Patent [19]

Lyndhurst

[11] Patent Number: 4,542,720

[45] Date of Patent: Sep. 24, 1985

[54] AIR-COOLED RECIPROCATING INTERNAL COMBUSTION ENGINE WITH REMOVABLE INDIVIDUAL HEADS FOR MULTIPLE CYLINDERS

[75] Inventor: Francis R. Lyndhurst, Costa Mesa, Calif.

[73] Assignee: Scat Enterprises, Inc., Redondo Beach, Calif.

[21] Appl. No.: 605,576

[22] Filed: Apr. 30, 1984

[51] Int. Cl.[4] ..... F02L 1/32; F01M 9/10; F02F 1/42

[52] U.S. Cl. ..... 123/90.38; 123/193 H

[58] Field of Search ..... 123/193 H, 41.82 A, 123/90.37, 90.38

[56] References Cited

U.S. PATENT DOCUMENTS

| | | | |
|---|---|---|---|
| 4,291,650 | 9/1981 | Formia et al. | 123/193 H |
| 4,345,552 | 8/1982 | Kasting et al. | 123/90.38 |
| 4,369,627 | 1/1983 | Kasting et al. | 123/193 H |

FOREIGN PATENT DOCUMENTS

| | | | |
|---|---|---|---|
| 58130 | 5/1979 | Japan | 123/193 H |
| 1003191 | 9/1965 | United Kingdom | 123/193 H |

*Primary Examiner*—Craig R. Feinberg
*Assistant Examiner*—David A. Okonsky
*Attorney, Agent, or Firm*—William W. Haefliger

[57] ABSTRACT

An internal combustion engine has two side-by-side cylinders associated with a common metallic block, the engine including:

(a) first and second heads separately connected to, and detachable from the respective cylinders, (b) and rocker arm assemblies including shafts carried by said heads to pivotally support valve controlling rocker arms, (c) each head may include two separate sections which are removably interconnected, one section removably connected to a cylinder and defining valve seats, and the other section carrying said rocker arm shaft. One section may include both head and rocker arm assemblies.

12 Claims, 12 Drawing Figures

21a
24
59
37
28
26
45
21
73
92
60
27
14a
25
66
91
90
65
58
14b
23
2
4

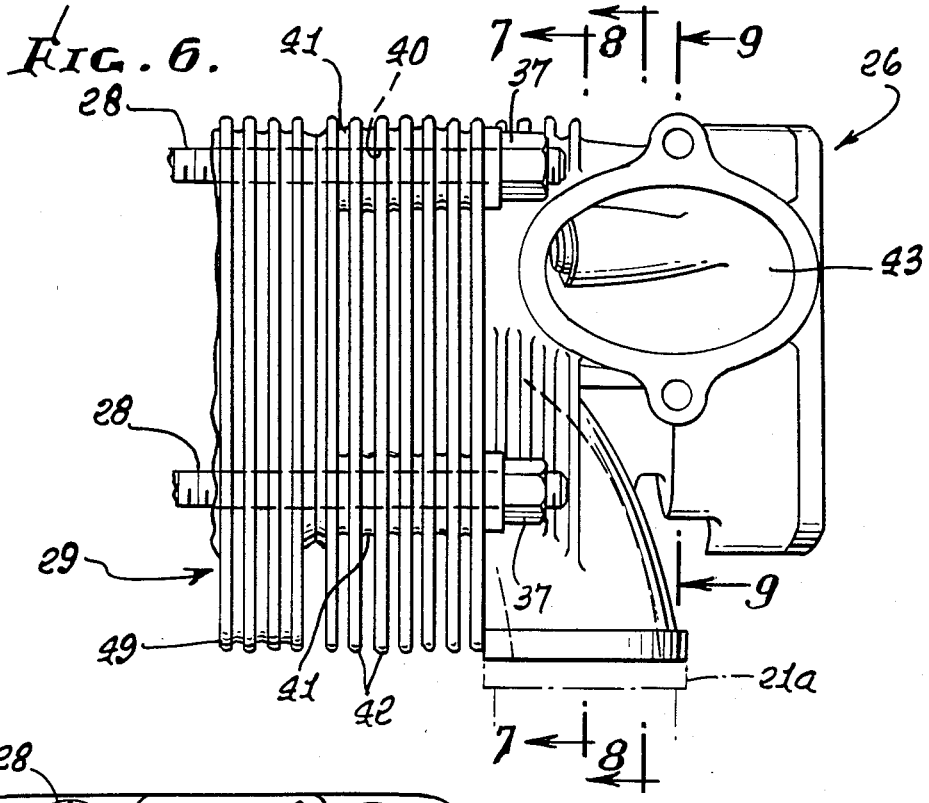
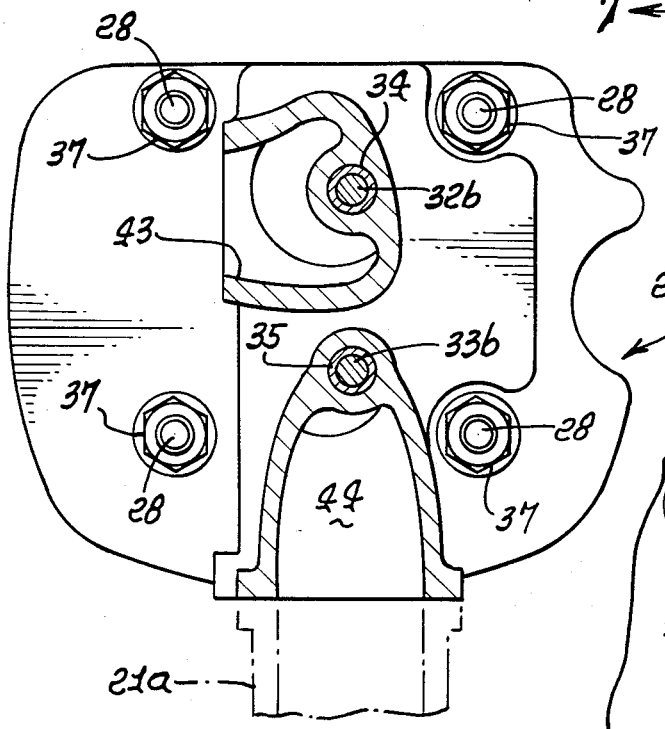
FIG. 7.
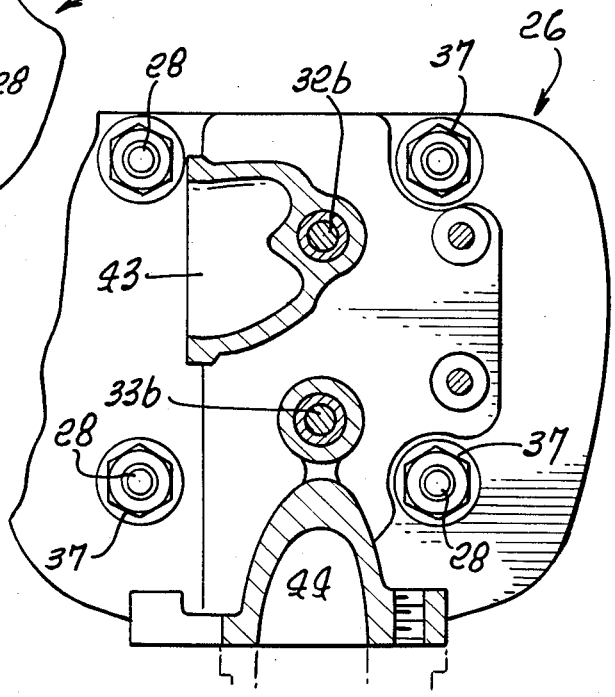
FIG. 8.

AIR-COOLED RECIPROCATING INTERNAL COMBUSTION ENGINE WITH REMOVABLE INDIVIDUAL HEADS FOR MULTIPLE CYLINDERS

BACKGROUND OF THE INVENTION

This invention relates generally to internal combustion engines of reciprocating type, and more particularly concerns improvements to engines having cylinders at opposite sides of a block, the cylinders located in side-by-side relation.

A common head for multiple cylinders is conventionally provided in engines of Volkswagen/Porsche type as for each bank of cylinders at opposite sides of a common block which contains the crankshaft. This means that internal access to the head for one cylinder cannot be gained without removing the entire head for multiple (as for example two) cylinders. Also, in such prior engines, it is difficult to gain access to the fasteners which connect the head to the multiple cylinders; and such fasteners commonly pass through cooling fins which can become deformed when the fasteners are tightened and which can lead to failure of gaskets between the cylinders and heads. In addition, it is difficult to gain access to the valves and rocker arm assemblies in such engines due to their construction, such access being desirable for repair and adjustment purposes.

SUMMARY OF THE INVENTION

It is a major object of the invention to provide an improved engine construction which obviates the above problems and difficulties, and which simplifies and reduces the time and expense of valve repair and adjustment, and head replacement. Basically, the invention is embodied in an engine having at least two side-by-side cylinders associated with a common block, and contemplates provision of:

(a) first and second heads separately connected to, and detachable from the respective cylinders, (b) and rocker arm assemblies including shafts or studs or bolts carried by such heads to pivotally support valve controlling rocker arms, (c) each head may include two separate sections which are removably interconnected, one section removably connected to a cylinder and defining valve seats, and the other section carrying the rocker arm shaft, or actuating mechanism.

As will appear, the one section typically defines openings four fasteners that connect the one section to the cylinder block, the openings located to permit removal of the fasteners only after removal of the other section from the one section, whereby each head is separately removable from its associated cylinder. Such removal of the other section is in turn facilitated by removal of interconnecting fasteners to which access is easily gained by prior removal of a cap mounted on the other section. In this regard, the other section typically carries rocker arms and a shaft or actuating mechanism therefor, the arm being removable from operative presentation to valve stems and push rods, upon removal of the other section from the one section.

As will be seen, the one section typically has load bearing tubular metallic columns to pass the fasteners that connect to the cylinder, cooling fins extending outwardly of and about such columns, These and other objects and advantages of the invention, as well as the details of an illustrative embodiment, will be more fully understood from the following description and drawings, in which:

DRAWING DESCRIPTION

FIG. 6 is a plan view on lines 6—6 of FIG. 2;

Figure 9:
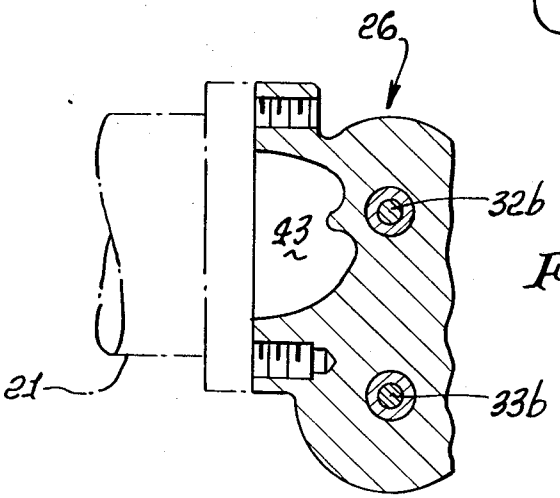
Figure 2:
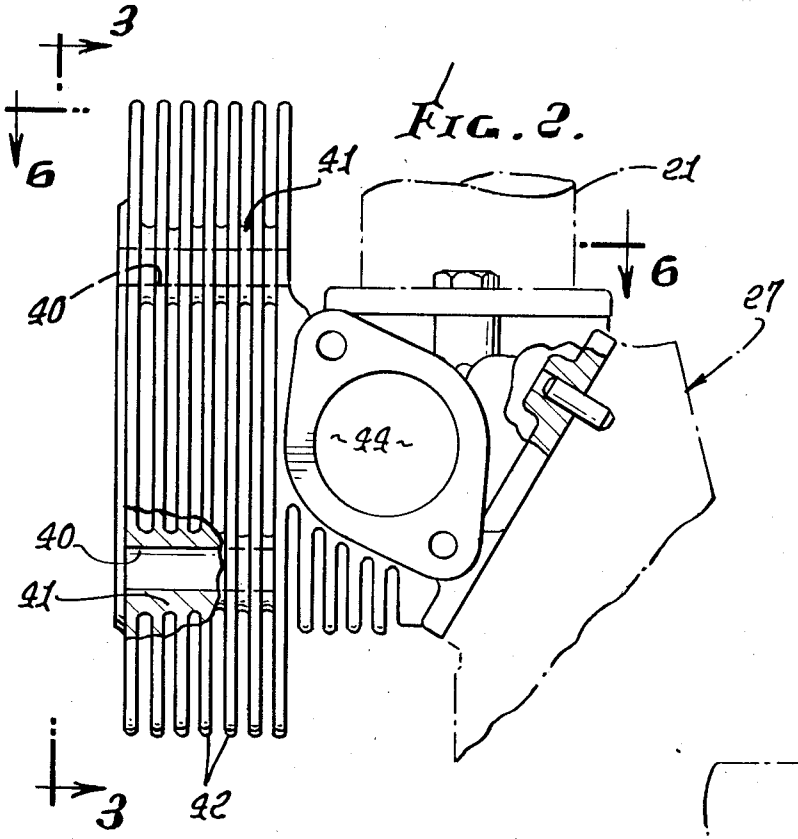
FIG. 2 is a vertical section taken on lines 2—2 of FIG. 1.
Figure 4:
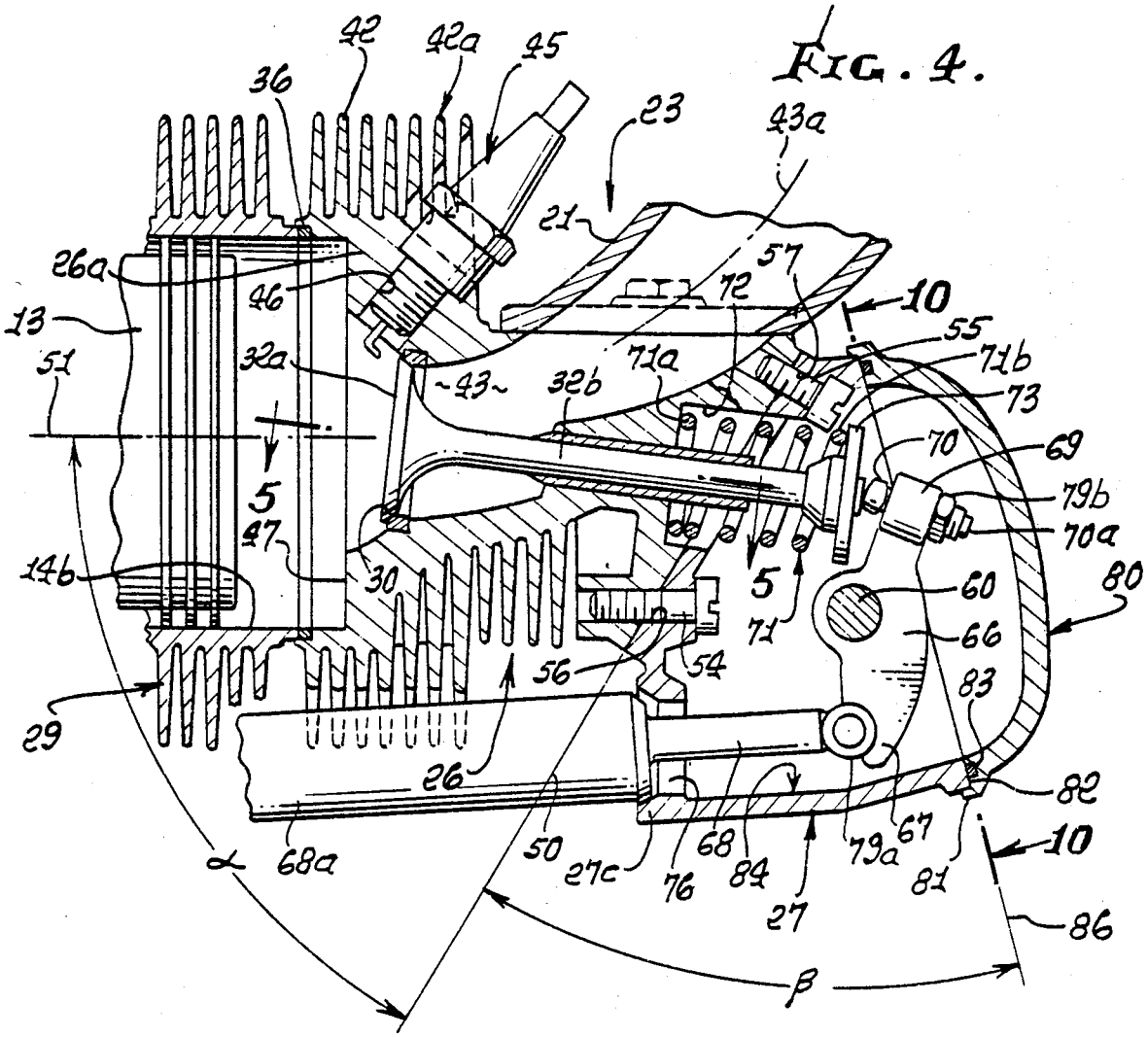
FIG. 4 is a vertical section taken on lines 4—4 of FIG. 1.
Figure 10:
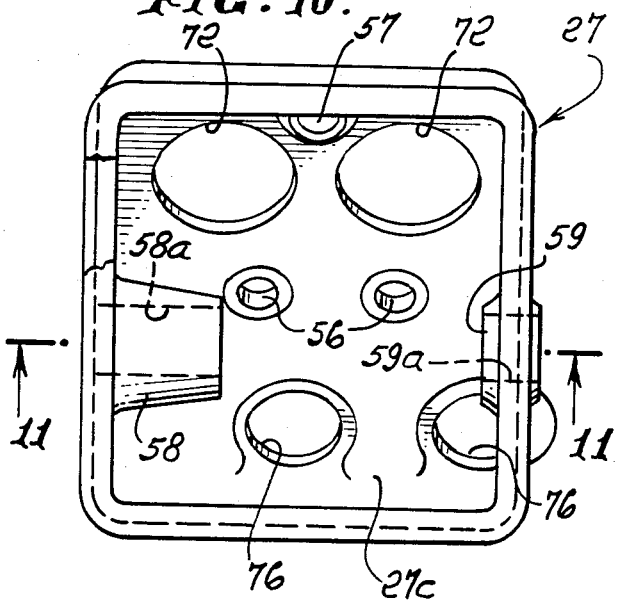
Figure 11:
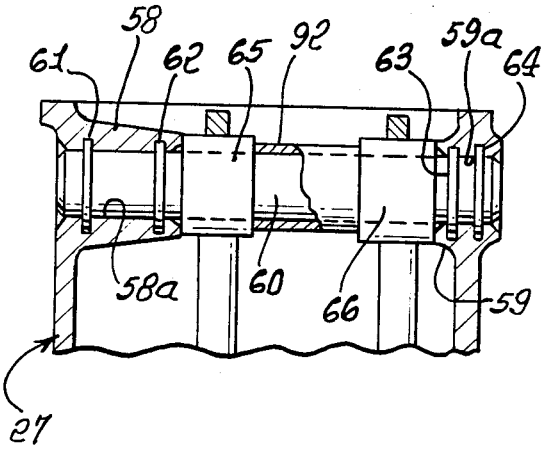

FIGS. 7, 8 and 9 are sections on lines 7—7, 8—8 and 9—9, respectively, of FIG. 6;

FIG. 10 is a frontal view of a section shown in FIG. 4, taken on lines 10—10 of FIG. 4;

FIG. 11 is a section on lines 11—11 of FIG. 10; and

Figure 12:
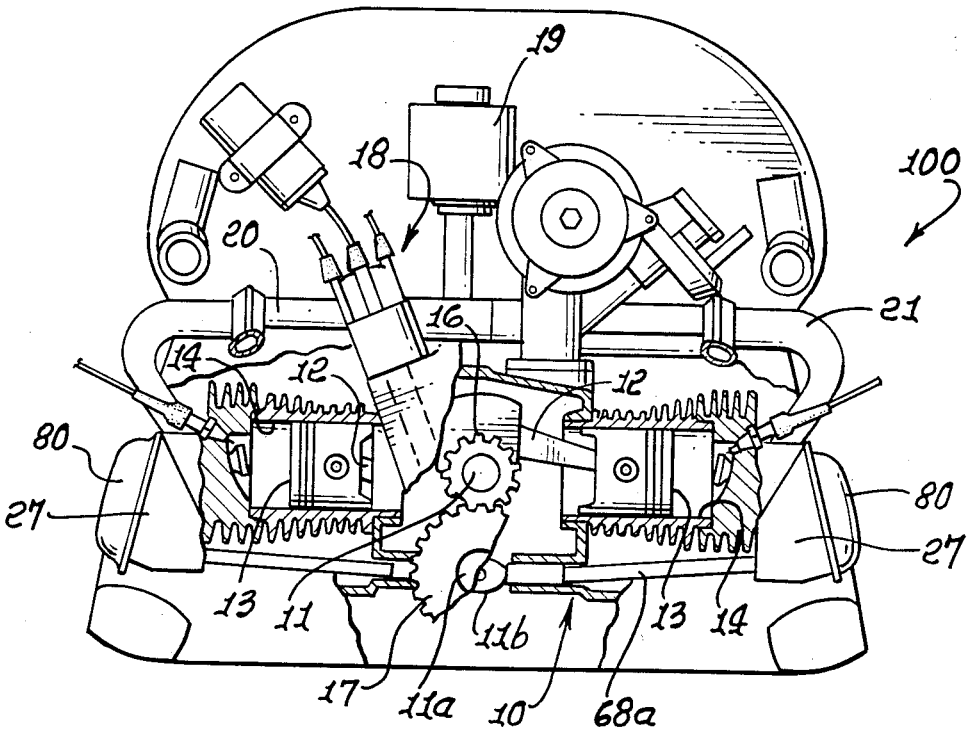

FIG. 12 is a vertical section through an internal combustion engine incorporating the invention.

DETAILED DESCRIPTION

In FIG. 12, the internal combustion engine 100 includes a block 10 that contains a crankshaft 11 connected via rods 12 with pistons 13. The latter are arranged in two parallel banks to reciprocate within cylinders 14 connected to the block at 15 and 16 and 17 driven by shaft 11 to drive cam shaft 11*a* having cams 11*b* at opposite sides of crankshaft 11. Also shown are timing gears controlling ignition distribution structure 18 and exhaust and intake valves to be described. The engine also includes carburetor 19 and air/fuel intake manifold ducts 20 and 21 extending to the two cylinder banks. Excepting for the improvements described herein, the engine is typically of Volkswagen/Porsche design, as described for example in the 1970–1974 Volkswagen Service Manual published by Robert Bentley, Inc., Cambridge, Mass.; Porsche Service Manual, published 1969, by Floyde Clymer Publication.

Figure 1:
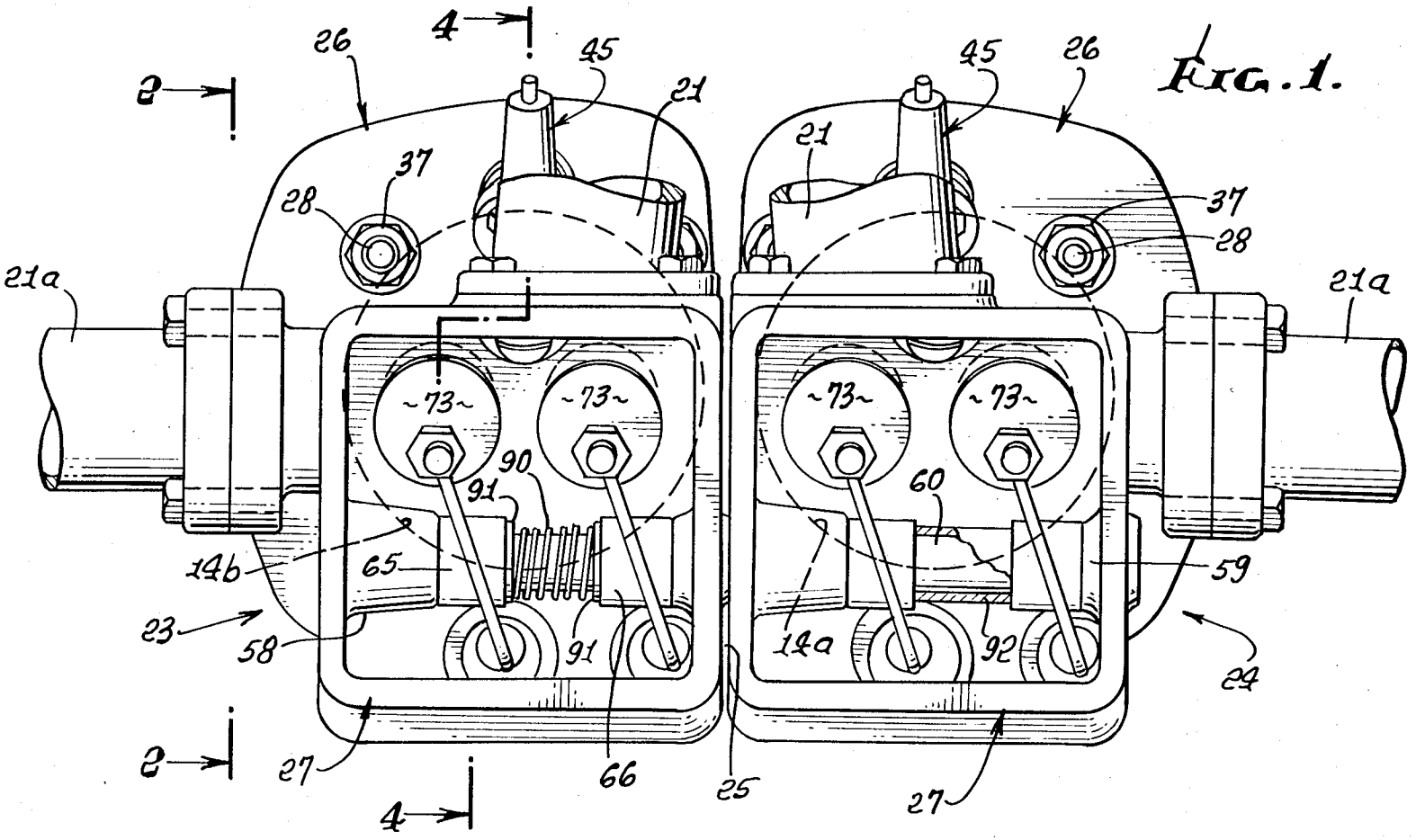
FIG. 1 is a top plan view of two side-by-side cylinders in an engine block.
Figure 3:
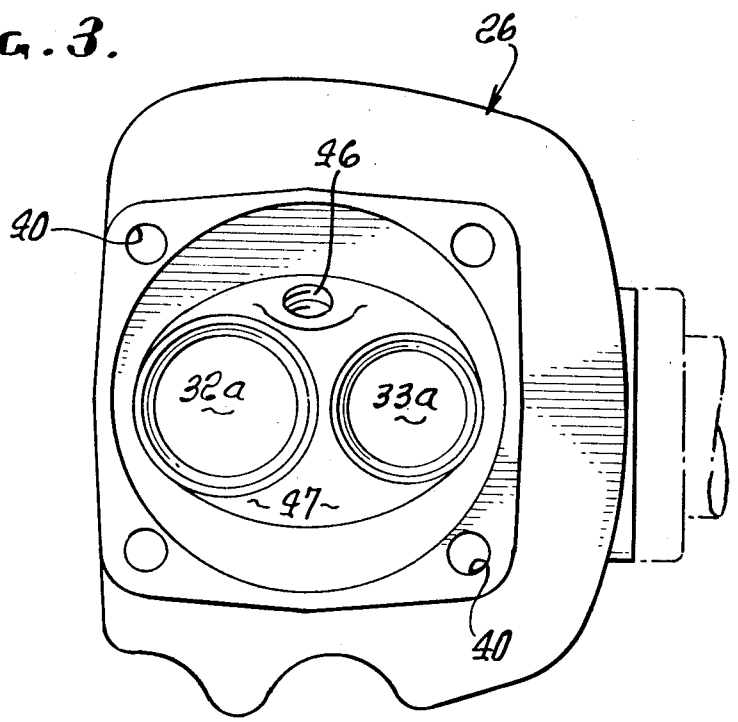
FIG. 3 is an end view on lines 3—3 of FIG. 2.

Each bank of cylinders 14 typically includes two such cylinders 14*a* and 14*b* located in side-by-side relation as seen in FIG. 1, and they may be located or formed in one cylinder block. In accordance with an important aspect of the invention, first and second like heads 23 and 24 are separately connected to and separately detachable from the respective cylinders. See for example, the gap 25 between the two heads, appearing in FIG. 1. Such construction facilitates and eases the replacement or repair of each head individually, as well as parts associated with same.

Figure 5:
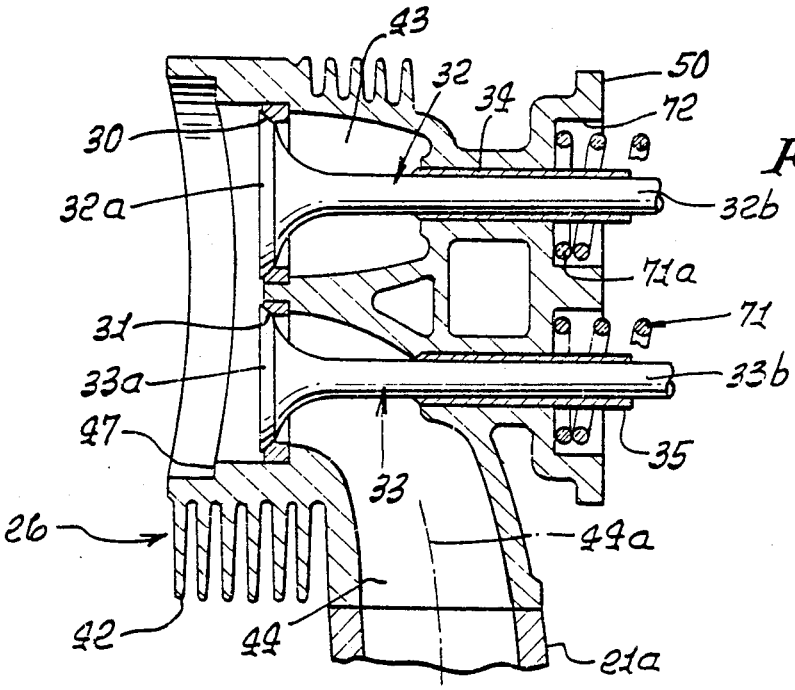
FIG. 5 is a section taken on lines 5—5 of FIG. 4.

Extending the description to FIG. 4, each head (for example head 23 as shown) may include two separate sections or castings, as for example at 26 and 27, which are removably interconnected. One section, as for example section 26, is removably connected as via four bolts or studs 28, through cylinder casting 29, to block 10, section 26 also carrying annular seats 30 and 31 for the heads 32*a* and 33*a* of inlet and exhaust valves 32 and 33. See FIGS. 4–6. Guides 34 and 35 for the valve stems 32*b* and 33*b* are also carried by the one section 26. FIGS. 6 and 7 show the four bolts or studs 28 connecting the head section 26 through the cylinder casting 29, to cylinder block 10 and a gasket 36 may be located (if desired) at the interface between section 26 and 29. Tightenable nuts 37 are provided on the studs, such nuts being easily endwise accessible after removal of the other or second section 27, as will be described. Bolts may be substituted.

Head sections 26 defines elongated, parallel, drilled openings 40 for the studs or bolts, such openings extending through metallic columns 41 carrying the outwardly extending metallic cooling fins 42. Fins 42 surround such columns, as is clear from FIG. 6; accordingly, compression force holding the sections 6 and 27 to the cylinders is transmitted through solid metallic columns, 41, whereby such force is not transmitted through the fins themselves, no destructive fin deflection thereby resulting from such compression force transmission. Also stud or bolt exerted holding force is equalized between the four columns 41. Note that fins 42 also extend between the columns. Cylinder fins appear at 49, as a continuity with fins 42.

Section 26 also defines smoothly curved gas flow ducts 43 and 44 (see FIGS. 4 and 5) communicating with the valve seats 30 and 31 for respectively passing the flow of the gaseous air/fuel mixture to the cylinder 14*b*, and the flow of exhaust gases from the cylinder. Duct 43 typically extends along a curved axis 43*a* which extends in a plane (of FIG. 4) normal to the plane (of FIG. 5) containing axis 44*a* of duct 44. Intake manifold 21 defines a continuation of duct 43; and discharge manifold 21*a* defines a continuation of duct 44. See also FIGS. 6–8. A spark plug 45 has thread connection at 46 to the portion 26*a* of section 26 located generally midway between the seats 30 and 31 and inwardly of fins 42*a*, in FIG. 4, portion 26*a* also being adjacent the top wall 47 of the combustion chamber, defined by section 26.

When removable, the other head section 27 is removably attached to section 26 along a parting plane 50 (see FIG. 4) extending at an angle $\alpha$ relative to a plane defined by the axes 51 of two cylinders in a bank. Angle $\alpha$ is typically between 45° and 90°, to facilitate compactness and access to rocker assembly components to be described. Two fasteners 54 xay be provided and received in openings 56 appearing in FIG. 10, and a drilled opening for a third fastener 55 may be provided as appears at 57, and is skewed relative to parallel openings 56. After such fasteners are removed, by gaining access to them as is clear from FIG. 10, the section 27 is then removable from section 26, to provide access to fasteners 28 referred to above. Therefore, each of the heads, including sections 26 and 27, is separately removable to provide access to the valves and associated rockers associated with each head, whereby savings in time and expense of repair are achieved.

FIGS. 10 and 11 also shows the provision of bosses 58 and 59 integral with section 27, and providing coaxial drilled openings 58*a* and 59*a* for reception and support of the end portions of rocker shaft 60. See FIG. 11 and the shaft retaining rings 61–64. The rocker arm assembly also includes rockers 65 and 66 pivotally supported on shaft 60. As shown in FIG. 4, one end 67 of each rocker is reciprocated by a spherical tip 79*a* on a push rod, as at 68; and the opposite end 69 of the rocker carries a spherical tip 70 that engages and depresses a valve stem, as at 32*b*. Return springs, as at 71, tension the stems toward the rockers. Note end 71*a* of spring 71 received in recess 72 in section 26, and opposite end 71*b* engaging retainer annulus 73 on the stem 32*b*. Inasmuch as springs 71 project into section 27, removal of the latter provides access to the spring assemblys and valves stems. Opening 76 in wall 27*c* of section 27 allows free passage of push rod 68, upon removal of section 27. See also push rod sleeves 68*a*.

Valve adjustment is afforded by the nut 79*a* on stem 70*a* of bearing 70. Access to such adjustment is provided, without requiring removal of section 27 by disconnection of a removable cap 80. Cap 80 has peripheral rim interfit at 81 with the rim 82 of section 27, whereby it is retained in place and is quickly removable and replaceable. A looping seal 83 may be provided in a cap rim recess everywhere located above the level of an oil drain back zone 84 through pushrod sleeve 68*a* defined by section 27. Accordingly, when the cap is removed, oil does not spill out from zone 84. Pressurized lubricating oil is suitably supplied to the rocker arms 65 and 66 through pushrods 68. Rim 82 defines a plane 86 extending at an angle $\beta$ relative to plane 50, being between 10° and 55°, for compactness as well as aiding in enhancing the above described advantages. Angle $\alpha$ is preferably about 58° and angle $\beta$ about 45°.

Upon removal of cap 80, the heads of fasteners 54 and 55 are exposed, enabling quick removal of said fasteners to permit disconnection of said other section 27 from said one section 26. Note also that the rocker arms and shaft 60, 65 and 66 or rocker arm actuating system are entirely carried by section 27, so are removable with that section upon its demounting from section 26.

In addition to what has been described, if it becomes desirable to vary the rocker arm ratio (i.e. the relative distance of the push rod and valve stem to the center of rocker rotation) it is possible merely to substitute another rocker arm mounting section 27, having the desired ratio, such substitution being possible after simple and rapid removal of cap 80 and the three fasteners 54 and 55.

FIGS. 1 and 11 also show the use of a spring 90 and two washers 91, and/or a sleeve 92, to maintain the rocker arms 65 and 66 in position.

I claim:

1. In an internal combustion engine having at least two side-by-side cylinders associated with a common metallic block, the improvement comprising (a) first and second heads separately connected to, and detachable from the respective cylinders, (b) and rocker arm assemblies including shafts carried by said heads to pivotally support valve controlling rocker arms, (c) each head including sections which are removably interconnected, one section removably connected to the cylinder and defining valve seats, and the other section carrying said rocker arm shaft, (d) each of said cylinders having an axis, said two axes being parallel, each pair of said sections interconnected along a first plane which extends at and angle $\alpha$ relative to said cylinder axes, $\alpha$ being about 58°, and including a cap removably attached to said other section, and a looping seal between said cap and said other section, said seal everywhere located above the level of an oil drain sump zone defined by said other section, said cap joined to said other section along a second plane which extends at an angle $\beta$ relative to said said first plane, $\beta$ being between 10° and 55°, (e) each said one section having a first side which is relatively large and a second and opposite side which is relatively short as determined by said angle $\alpha$, said one section defining, proximate said first side, an intake air/fuel mixture flow duct which extends, with smooth curvature, generally lengthwise of and through said one side and toward an intake valve seat spaced from said cylinder, (f) there being valve stems actuated by said rocker arm assemblies, the valve stems solely carried by said head one section via valve guides which are generally in lateral registration with the longitudinal intersections of the flow duct with said first side.

2. In an internal combustion engine having at least two side-by-side cylinders associated with a common metallic block, the improvement comprising (a) first and second heads separately connected to, and detachable from their respective cylinders, (b) and rocker arm assemblies including shafts carried by said heads to pivotally support valve controlling rocker arms, (c) each head including sections which are removably interconnected, one section removably connected to the cylinder and defining valve seats, and the other section carrying said rocker arm shaft, (d) each of said cylinders having an axis, said axes being parallel, each pair of said sections interconnected along a first plane which extends at an angle $\alpha$ relative to said cylinder axes, $\alpha$ being about 58°.

(e) each said one section having a first side which is relatively large and a second and opposite side which is relatively short as determined by said angle $\alpha$, said one section defining, proximate said first side, an intake air/fuel mixture flow duct which extends, with smooth curvature, generally lengthwise of and through said one side and toward an intake valve seat spaced from said cylinder, (f) there being valve stems actuated by said rocker arm assemblies, the valve stems solely carried by said head one section via valve guides which are generally in lateral registration with the longitudinal intersections of the flow duct with said first side.

3. The improvement of claim 2 including fasteners interconnecting said two sections, said fasteners having heads exposed upon removal of said cap.

4. The improvement of claim 3 wherein said rocker arm assembly includes two rockers at opposite ends of said shaft carried by said other section, whereby said assembly is removable with said other section when said other section is separated from said one section.

5. The improvement of claim 2 wherein said one section defines openings for fasteners that connect the one section to the block, said openings located to permit removal of said fasteners after removal of said other section from said one section.

6. The improvement of claim 5 including said fasteners in said openings, access to at least one fastener blocked by said other section and the rocker assembly carried thereby.

7. The improvement of claim 6 wherein there are four of said fasteners, and including additional fastener means connecting said other section to said one section.

8. The improvement of one of claims 2 or 5 wherein each head has metallic columns add cooling fins extending outwardly of said columns, said columns defining openings for fasteners that connect the head to the block.

9. The improvement of one of claims 5 or 6 wherein said one section has metallic columns and cooling fins extending outwardly of said columns, said columns defining said fastener openings whereby bolt fastening compression force is transmitted by said columns independently of the fins.

10. The improvement of one of claims 2, 5, or 6 including bosses carried by said other section and supporting end portions of the rocker shaft.

11. The improvement of one of claims 2, 5, or 6 wherein said one section also defines a second duct, said two ducts communicating with said valve seats for respectively passing the flow of the gaseous air/fuel mixture to the cylinder, and the flow of exhaust gases from the cylinder, said ducts smoothly contoured throughout their lengths.

12. The improvement of one of claims 2, 5, or 6 including a cap removably attached to said other section, and a looping seal between said cap and said other sections, said seal everywhere located above the level of an oil drain sump zone defined by said other section.

* * * * *